US012089635B2

(12) United States Patent
Aw et al.

(10) Patent No.: US 12,089,635 B2
(45) Date of Patent: Sep. 17, 2024

(54) EXTRACTOR FOR AN AEROSOL-GENERATING DEVICE

(71) Applicant: Philip Morris Products S.A., Neuchatel (CH)

(72) Inventors: Sze Chiek Aw, Singpore (SG); Roland Antonopoulos, Neuchatel (CH); Jean-Luc Fringeli, Singapore (SG); Prasad Girme, Singapore (SG)

(73) Assignee: Philip Morris Products S.A., Neuchatel (CH)

( * ) Notice: Subject to any disclaimer, the term of this patent is extended or adjusted under 35 U.S.C. 154(b) by 755 days.

(21) Appl. No.: 17/263,364

(22) PCT Filed: Jul. 30, 2019

(86) PCT No.: PCT/EP2019/070547
§ 371 (c)(1),
(2) Date: Jan. 26, 2021

(87) PCT Pub. No.: WO2020/025637
PCT Pub. Date: Feb. 6, 2020

(65) Prior Publication Data

US 2021/0282458 A1 Sep. 16, 2021

(30) Foreign Application Priority Data

Aug. 1, 2018 (EP) ..... 18186909

(51) Int. Cl.
*A24F 40/40* (2020.01)
*A24F 7/02* (2006.01)
*A24F 40/20* (2020.01)

(52) U.S. Cl.
CPC ..... *A24F 40/40* (2020.01); *A24F 7/02* (2013.01); *A24F 40/20* (2020.01)

(58) Field of Classification Search
CPC .. A24F 40/40; A24F 40/20; A24F 7/02; A24F 47/00; A24F 47/02; A24F 47/002; A24F 47/006; A24F 47/008; A61M 15/06
(Continued)

(56) References Cited

U.S. PATENT DOCUMENTS 5,144,962 A 9/1992 Counts et al.
9,693,587 B2 * 7/2017 Plojoux ..... A61M 15/06
(Continued)

FOREIGN PATENT DOCUMENTS

CN 103997922 A 8/2014
CN 205597118 U 9/2016
(Continued)

OTHER PUBLICATIONS

Combined Russian Office Action and Search Report issued Nov. 30, 2022, in corresponding Russian Patent Application No. 2021103130/03(006763) (with English Translation of Search Report), 9 pages.
(Continued)

*Primary Examiner* — Gary F Paumen
(74) *Attorney, Agent, or Firm* — Oblon, McClelland, Maier & Neustadt, L.L.P.

(57) ABSTRACT

An extractor configured to extract an aerosol-generating article received in an aerosol-generating device is provided, the extractor including: a body defining a cavity configured to receive an aerosol-generating article; and a resilient coupling element attached to the body, the resilient coupling element is movable independent of the body to releasably couple the extractor to a portion of the aerosol-generating device. There is also provided an aerosol-generating device and a mouthpiece for an aerosol-generating device, both including the extractor.

16 Claims, 7 Drawing Sheets

(58) Field of Classification Search
USPC ..... 131/273
See application file for complete search history.

(56) References Cited

U.S. PATENT DOCUMENTS

| | | | | |
|---|---|---|---|---|
| 11,213,635 | B2 * | 1/2022 | Hepworth | A61M 11/042 |
| 11,246,342 | B2 * | 2/2022 | Mahler | A24F 40/42 |
| 11,388,929 | B2 * | 7/2022 | Reevell | A24F 40/40 |
| 2015/0013696 | A1 * | 1/2015 | Plojoux | A61M 15/06 131/328 |
| 2018/0049472 | A1 * | 2/2018 | Mahler | A61M 15/0023 |
| 2019/0166909 | A1 | 6/2019 | Reevell | |
| 2019/0254345 | A1 | 8/2019 | Hepworth et al. | |

FOREIGN PATENT DOCUMENTS

| | | | |
|---|---|---|---|
| CN | 206687163 | U | 12/2017 |
| EP | 3 220 987 | A1 | 9/2017 |
| JP | 2010-20929 | A | 1/2010 |
| JP | 2014-533513 | A | 12/2014 |
| JP | 2017-127300 | A | 7/2017 |
| JP | 2017-163975 | A | 9/2017 |
| JP | 2017-533726 | A | 11/2017 |
| JP | 2018-504134 | A | 2/2018 |
| KR | 10-2014-0093694 | | 7/2014 |
| RU | 2 620 491 | C2 | 5/2017 |
| TW | 201328616 | A1 | 7/2013 |
| WO | WO 2013/076098 | A2 | 5/2013 |
| WO | WO 2013/098405 | A2 | 7/2013 |
| WO | WO 2016/079155 | A1 | 5/2016 |
| WO | WO 2016/124550 | A1 | 8/2016 |
| WO | WO 2017/186455 | A1 | 11/2017 |
| WO | WO 2018/050612 | A1 | 3/2018 |

OTHER PUBLICATIONS

Combined Taiwanese Office Action and Search Report issued Nov. 23, 2022, in corresponding Taiwanese Patent Application No. 108127021 (with English Translation), 20 pages.

International Search Report and Written Opinion issued Oct. 28, 2019 in PCT/EP2019/070547 filed Jul. 30, 2019.

Japanese Office Action issued Sep. 4, 2023 in Japanese Patent Application No. 2021-503152 (with English Translation), 7 pages.

Combined Chinese Office Action and Search Report issued Sep. 22, 2023 in Chinese Patent Application No. 201980046291.9 (with English Translation), 13 pages.

Korean Office Action mailed on Jun. 17, 2024 issued in Korean Patent Application No. 10-2021-7002202, with English Translation, total 10 pages.

Japanese Office Action mailed on Aug. 5, 2024 issued in Japanese Patent Application No. 2021-503152, with English Translation, total 4 pages.

* cited by examiner

EXTRACTOR FOR AN AEROSOL-GENERATING DEVICE

The present invention relates to an extractor for extracting an aerosol-generating article received in an aerosol-generating device. The present invention further relates to an aerosol-generating device and a mouthpiece comprising such an extractor.

A number of prior art documents disclose aerosol-generating devices that include, for example, heated aerosol-generating systems and electrically heated aerosol-generating systems. One advantage of these systems is that they significantly reduce sidestream smoke, while permitting the smoker to selectively suspend and reinitiate aerosol-generating. An example of a heated aerosol-generating system is disclosed in U.S. Pat. No. 5,144,962, which includes in one embodiment a flavour-generating medium in contact with a heater. When the medium is exhausted, both it and the heater are replaced. An aerosol-generating device where a substrate can be replaced without the need to remove the heating element is desirable.

WO2013/076098 and WO2016/124550 provide disclosures of an aerosol-generating device having a heater that is insertable into the aerosol-forming substrate of an aerosol-generating article and an extractor for facilitating the removal of the aerosol-generating article after use. Such disclosures describe extractors having a stopper protruding from outside of the extractor. The stopper is arranged to cooperate with indents located within a sleeve, which is located within the aerosol-generating device, and thus couple the extractor to the aerosol-generating device. However, this engagement mechanism, i.e. the cooperation of the indents and protruding stopper, is not always reliable, and can deteriorate over time. This can lead to difficulties in removal or detachment and re-attachment of the extractor, and can also affect the stability and usability of the device. It would therefore be desirable to provide an improved extractor for facilitating the removal of the aerosol-generating article, which does not suffer from such problems.

According to a first aspect of the present invention, there is provided an extractor for extracting an aerosol-generating article received in an aerosol-generating device. The extractor comprises a body defining a cavity for receiving an aerosol-generating article and a resilient coupling element attached to the body of the extractor. The resilient coupling element is movable relative to the body of the extractor to releasably couple the extractor to a portion of an aerosol-generating device. Preferably, the resilient coupling element is movable independent of the body of the extractor to releasably couple the extractor to a portion of an aerosol-generating device.

The term "releasably couple" means that the body of the extractor is configured to couple with a portion of an aerosol-generating device so that the extractor is substantially immovably coupled to said portion of the aerosol-generating device, and also that the body of the extractor is configured to be released from being immovably coupled to the portion of the aerosol-generating device so that the body of the extractor can move relative to said portion of the aerosol-generating device.

The features described in the following preferred embodiments may be provided in any of the aspects of the present invention, and in any suitable combination.

By providing a resilient coupling element attached to the body of the extractor and arranging for said element to be movable independent of the body of the extractor, the extractor can be repeatedly attached to and detached from the rest of the aerosol-generating device, without causing any deformation of the extractor body. This is because only the resilient coupling element will move or deform as the extractor engages and disengages with the rest of the aerosol-generating device. This can advantageously mean that the body of the extractor will have a longer life span because it will not undergo excessive repeated deformation, and the resilient coupling element can be designed to be particularly suited to such repeated deformation. Additionally, a more consistent aerosol delivery may be obtainable from puff-to-puff if the extractor body is not being repeatedly deformed during use of the aerosol-generating device.

This contrasts with prior art extractors whose bodies would have to undergo repeated deformation when being removed from and inserted into the device, thereby affecting the material life of the extractor body due to such repeated deformation and potentially resulting in deterioration and, possibly, full breakage of the extractor body. Such deterioration can also affect the performance of the extractor. That is, it can negatively affect the extractor's capacity to repeatedly attach to the device. This can negatively affect a user's experience of the device.

As used herein, an 'aerosol-generating device' refers to a device that interacts with an aerosol-forming substrate to generate an aerosol. The aerosol-forming substrate may be part of an aerosol-generating article. An aerosol-generating device may comprise one or more components used to supply energy from a power supply to an aerosol-forming substrate to generate an aerosol. For example, an aerosol-generating device may be a heated aerosol-generating device. An aerosol-generating device may be an electrically heated aerosol-generating device or a gas-heated aerosol-generating device. An aerosol-generating device may be an aerosol-generating device that interacts with an aerosol-forming substrate of an aerosol-generating article to generate an aerosol that is directly inhalable into a user's lungs thorough the user's mouth. An aerosol-generating device may be a holder.

As used herein, the term 'aerosol-generating article' refers to an article comprising an aerosol-forming substrate that is capable of releasing volatile compounds that can form an aerosol. For example, an aerosol-generating article may be an aerosol-generating article that generates an aerosol that is directly inhalable into a user's lungs through the user's mouth. An aerosol-generating article may be disposable. The term 'aerosol-generating article' is generally used hereafter.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or aerosol-generating article.

Preferably, an aerosol-generating article is a heated aerosol-generating article, which is an aerosol-generating article comprising an aerosol-forming substrate that is intended to be heated rather than combusted in order to release volatile compounds that can form an aerosol. The aerosol formed by heating the aerosol-forming substrate may contain fewer known harmful constituents than would be produced by combustion or pyrolytic degradation of the aerosol-forming substrate. An aerosol-generating article may be, or may comprise, a tobacco stick.

The extractor body is preferably suitably designed for receiving an aerosol-generating article. This means that the cavity defined by the extractor body substantially corresponds to the shape or profile of the aerosol-generating article it is configured to receive.

The extractor body is preferably designed such that particles of aerosol-forming substrate, or other debris that may derive from an aerosol-generating article, are trapped or retained within the extractor portion of the aerosol-generating device when the aerosol-generating article has been extracted. The extractor may then be removed from the device and cleaned on a regular basis to maintain the consumer experience.

The present invention further allows the integrity of the aerosol-generating article to be substantially maintained as the aerosol-generating article is removed from the aerosol-generating device. The risk that loose shreds of aerosol-forming substrate from the aerosol-generating article are produced during removal and retained in the aerosol-generating device is significantly reduced. This is advantageous because the aerosol-generating device will need less frequent cleaning.

Preferably, the body of the extractor has a first end defining the opening of the cavity and an opposed second end, and wherein at least a first portion of the resilient coupling element extends in a direction from the first end to the second end. The first portion of the resilient coupling element may be elongate. The provision of an opening allows the aerosol-generating article to be received within the extractor through the first end.

The distance between the opposing first and second ends of the extractor body define a longitudinal length of the extractor or extractor body.

Preferably, the body of the extractor may comprise a face against which the aerosol-generating article abuts when the aerosol-forming substrate of the aerosol-generating article is correctly positioned within the extractor. This indicates to the user that the aerosol-generating article is fully inserted into the extractor body. This reduces the chance of damage to the aerosol-forming substrate during insertion.

Preferably, the first end is an open end and the second end is a substantially closed end. The second substantially closed end may form an end support face which may provide a support or a seat for the aerosol-generating article received within the extractor. Alternatively, both the first and second ends are open ends, wherein a support face for providing a support or a seat for the aerosol-generating article is located within the extractor at a position between said first and second open ends. Preferably, the aerosol-generating article substantially abuts against the support face.

Orientating the resilient coupling element in such a manner allows for effective re-attachment and detachment of the extractor without applying excessive deformation to the resilient coupling element. This is because the opposed second end of the extractor body is preferably facing the aerosol-generating device when the extractor is being coupled to the device. Thus, the first portion of the resilient coupling element is preferably extending in the same direction as the direction of the movement required for the body of the extractor to be releasably coupled to an aerosol-generating device, or a portion thereof. Further, the first portion of the resilient coupling element is subjected to minimum outward bending forces, particularly, when a user is detaching the extractor by pulling it away from an aerosol-generating device.

Alternatively, the first portion of the resilient coupling element may be orientated the opposite way. Put another way, at least a first portion of the resilient coupling element may extend in a direction from the first end to the second end.

The first portion of the resilient coupling element may not extend past either the first or second end of the body. Alternatively, the first portion of the resilient coupling element may extend past either the first or second end of the body.

The extractor body may further define an air-flow channel for allowing air to flow into the cavity. In use, a user may draw on an end of an aerosol-generating article received in the cavity. The aerosol-generating article comprises an aerosol-forming substrate that is heated by the heater. Air is drawn into the cavity through the air-flow channel and flows over the aerosol-forming substrate. Volatile components generated from the heated aerosol-forming substrate are entrained into the air-flow and condense, forming an inhalable aerosol.

Preferably, the first portion of the resilient coupling element extends from a proximal end of the first portion attached to the body of the extractor to a distal end of the first portion spaced away from the body of the extractor.

The proximal end of the first portion of the resilient coupling element may be attached at any point along the body of the extractor. In some embodiments, the proximal end of the first portion of the resilient coupling element is attached to a point along the body of the extractor between the first end of the body of the extractor and the mid-point along the length of the body of the extractor.

The distal end of the first portion of the resilient coupling element is located at a position between the first and second ends of the extractor body. Alternatively, the distal end of the first portion of the resilient coupling element may be located at a position past either the first or second ends of the extractor body, such that the resilient coupling element extends outboard of the extractor body.

The first portion of the resilient coupling element may have any suitable length. Preferably, the length of the first portion of the resilient coupling element is less than the length of the extractor body. In some preferred embodiments, the length of the first portion of the resilient coupling element is from about 25 percent to about 75 percent of the length of the extractor body. Such lengths may advantageously allow for the resilient coupling element to be included as part of the extractor without any, or any significant, increase in the footprint of the extractor. Such lengths may also allow the resilient coupling element to be sufficiently deflectable in order to releasably couple the extractor to an aerosol-generating device.

Preferably, the resilient coupling element further comprises a second portion, the second portion having a first end attached to the body of the extractor and a second end disposed away from the body of the extractor.

The first and second portions of the resilient coupling element may be joined to each other. In particular, the second end of the second portion may be joined to the proximal end of the first portion of the resilient coupling element, or may be joined to any other location along the first portion. In such embodiments, the first and second portions of the resilient coupling element may integrally formed together.

Preferably, a protrusion is provided on the first portion of the resilient coupling element, the protrusion extending away from the body of the extractor.

The protrusion may be configured to releasably engage with a portion of the aerosol-generating device. The portion of the aerosol-generating device may be a casing comprising one or more apertures or indents for receiving the protrusion of the resilient coupling element. The portion of the aerosol-generating device may be any suitable portion that is suitable for receiving the extractor and having suitable means for receiving or cooperating with the protrusion of the resilient coupling element.

Preferably, the protrusion has a first sloped face orientated towards the first end of the extractor body, and a second sloped face orientated towards the second end of the extractor body.

Preferably, the second sloped face is more gradually sloped than the first sloped face.

The protrusion may comprise a cam-shaped element, a lug, an angled or bent portion, a hook, a stud, a bead or any other suitable protruding element configured to be received by or snapped into an aperture or indent. For example, in some preferred embodiments, the first portion of the resilient coupling element may comprise a bent portion in which a first sloped face and a second sloped face are formed.

The first sloped face of the protrusion may be configured to enable deflection or movement of the resilient coupling element towards the extractor body when the extractor is being inserted into a portion of the aerosol-generating device so as to enable coupling of the extractor to said portion of the device. In other words, the sliding movement of the extractor within the portion of the aerosol-generating device presses the resilient coupling element towards the body of the extractor, as the first sloped face slides against an edge of the portion of the aerosol-generating device. The steepness of the first sloped face determines how much force is required to deflect the resilient coupling element towards to the extractor body when the extractor is being inserted into the portion of the aerosol-generating device. The steeper the first sloped face is, the greater the force required to deflect the resilient coupling element. The steepness of the second sloped face determines how much force is required to deflect the resilient coupling element towards to the extractor body when the extractor is being released from engagement with an aperture or indent of the portion of the aerosol-generating device. The steeper the second sloped face is, the greater the force required to deflect the resilient coupling element when pulling the protrusion out of engagement with an aperture or indent of the portion of the aerosol-generating device. Thus, the forces required for engagement and disengagement, or coupling and decoupling, of the extractor from the portion of the aerosol-generating device depend substantially on the shape of the protrusion and the steepness of the first and second sloped faces thereof.

Accordingly, the first and second sloped faces of the resilient coupling element respectively determine the forces required to releasably couple and decouple the extractor to and from the portion of the aerosol-generating device. It is preferable that the second sloped face is more gradually sloped than the first sloped face so that it is more difficult for a user to accidentally decouple the extractor during use of the aerosol-generating device. If the first portion of the resilient coupling element is orientated the opposite way, in other words, at least a first portion of the resilient coupling element extends in a direction from the first end to the second end; then it is preferable that first sloped face is more gradually sloped than the second sloped face.

Preferably, the protrusion is provided proximate to or at the distal end of the first portion of the resilient coupling element. Alternatively, the protrusion may be provided at any position along the first portion of the resilient coupling element.

Preferably, the resilient coupling element is pivotable or bendable relative to the body of the extractor. The resilient coupling element is preferably configured to pivot or bend independent of the body of the extractor. The resilient coupling element preferably comprises a deflectable or bendable cantilever element. As discussed above, the resilient coupling element being moveable relative to or independent of the extractor body ensures that minimum or no force is transferred from the resilient coupling element to the body when the resilient coupling element is deflected or bent relative to the body. For this reason, the resilient coupling element may be made of a plastic material, given the high level of flexibility of plastic materials. Other materials, such as metals, may also be suitable.

Preferably, the resilient coupling element may be biased towards a biased position. The resilient coupling element may be a spring-loaded device or element. The resilient coupling element may be a resilient projecting element configured for snap-fit engagement with a portion of the aerosol-generating device. Such a resilient projecting element may be a cantilever, a girder or a beam. A pivot point or hinge may be provided on the extractor body so that the resilient coupling element can move towards and away from the extractor body. When the resilient coupling element comprises a first portion and a second portion, the pivot point or hinge may be provided at the intersection between the first and second portions.

Preferably, the resilient coupling element comprises a longitudinal extension and is attached to the extractor body such that it has one end attached to the extractor body and a remote end spaced away from the extractor body.

Preferably, the resilient coupling element is separable from the body of the extractor. This is advantageous as this enables the resilient coupling element to be replaceable if it breaks during use, without needing to replace an entire extractor body having an integral coupling element. Replacement of the resilient coupling element may be cheaper to replacement of the whole extractor. This is because the resilient coupling element may not be integral to the extractor body. Furthermore, the inclusion of a resilient coupling element according to the present invention should not significantly impact the manufacture of present extractors or aerosol-generating devices.

Preferably, the extractor further comprises one or more additional resilient coupling elements, wherein each additional resilient coupling element is attached to the body of the extractor, and wherein each additional resilient coupling element is movable relative to the body of the extractor to releasably couple the extractor to a portion of an aerosol-generating device. Preferably, the extractor further comprises one or more additional resilient coupling elements, wherein each additional resilient coupling element is attached to the body of the extractor, and wherein each additional resilient coupling element is movable independent of the body of the extractor to releasably couple the extractor to a portion of an aerosol-generating device.

Preferably, the extractor further comprises a single additional resilient coupling element, wherein the single additional resilient coupling element is attached to the body of the extractor, and wherein the single additional resilient coupling element is movable relative to the body of the extractor to releasably couple the extractor to a portion of an aerosol-generating device. Preferably, the extractor further comprises a single additional resilient coupling element, wherein the single additional resilient coupling element is attached to the body of the extractor, and wherein the single additional resilient coupling element is movable independent of the body of the extractor to releasably couple the extractor to a portion of an aerosol-generating device.

Preferably, the resilient coupling element and the additional resilient coupling element or elements are symmetrically positioned on or about the extractor body. For example, where the extractor body has a substantially circular cross section, the resilient coupling elements may be equally spaced around the circumference of the extractor body.

Each additional resilient coupling element may have any combination of the features described above in respect of the resilient coupling element.

According to a second aspect of the present invention, there is provided an aerosol-generating device capable of receiving an aerosol-generating article. The device comprises: a heater casing or sleeve containing a heater for heating an aerosol-generating article; and an extractor according to the first aspect of the present invention, wherein the resilient coupling element is configured to releasably couple the extractor to the heater casing or sleeve.

The aerosol-generating device comprises a heater casing for receiving the extractor, such that the extractor is arranged to slide into the heater casing. Preferably, the heater casing forms part of the housing of the aerosol-generating device. Alternatively, the heater casing may comprise a separate component configured to be coupled to the aerosol-generating device.

The heater casing may comprise a tube having at least one open end for receiving the extractor, and aerosol-generating article received in the extractor. The extractor body may have a substantially cylindrical shape and form a sliding receptacle having a diameter slightly smaller than the diameter of the heater casing, such that the extractor body can be substantially received in the heater casing. The extractor body may include a flange arranged to abut an end of the heater casing when the extractor body is fully connected to the heater casing.

The heater casing may further provide a protruding guide track running longitudinally along the interior surface of the heater casing. The guide track is arranged to cooperate with a slot or groove located along the outer surface of the extractor body. The engagement of the guide track with the corresponding slot on the extractor body ensures that the extractor body does not rotate when positioned or sliding within the heater casing. Alternatively, the heater casing may further provide a guide slot and the extractor body may have a protrusion configured to cooperate with the guide slot of the heater casing so that the extractor body does not rotate when positioned or sliding within the heater casing.

The heater casing further provides a container for the heater to be substantially contained therein. This can reduce the likelihood of a user coming into direct contact with the heater of the device.

The effective diameter of the extractor body together with the resilient coupling element may be greater than the diameter of the heater casing.

The aerosol-generating device may be an electrically heated aerosol-generating system comprising a heater, preferably an electric heater. Alternatively, the aerosol-generating device may be a heater aerosol-generating system comprising a gas-burner, or some source of heat other than electricity. Alternatively, there is provided an electrically heated aerosol-generating system for receiving an aerosol-generating article including an aerosol-forming substrate, the electrically heated aerosol-generating system capable of positioning the aerosol-generating article and comprising: an electric heater for heating the aerosol-forming substrate; and an extractor for extracting an aerosol-generating article received in the electrically heated aerosol-generating system, wherein the extractor is in accordance with any embodiment of the first aspect of the present invention.

The term "electric heater" refers to one or more electric heating elements. The electric heater may comprise an internal electric heating element for at least partially inserting into the aerosol-forming substrate of the aerosol-generating article when the aerosol-generating article is received in the extractor and the extractor is close to the heater. An "internal heating element" is one which is suitable for insertion or penetration into an aerosol-generating material. The invention is particularly advantageous when used in conjunction with an internal heating element since, in that case, there may be a tendency for the aerosol-forming substrate to stick to the heating element and therefore to break up as the aerosol-forming substrate is separated from the heating element.

Alternatively or additionally, the electric heater may comprise an external heating element. The term "external heating element" refers to one that at least partially surrounds the aerosol-forming substrate. The electric heater may comprise one or more internal heating elements and one or more external heating elements.

The electric heater may comprise a single heating element. Alternatively, the electric heater may comprise more than one heating element. The heating element or heating elements may be arranged appropriately so as to most effectively heat the aerosol-forming substrate.

The electric heater may take any suitable form. For example, the electric heater may take the form of a heating blade. Alternatively, the electric heater may take the form of a casing or substrate having different electro-conductive portions, or an electrically resistive metallic tube. Alternatively, one or more heating needles or rods that run through the centre of the aerosol-forming substrate may be as already described. Alternatively, the electric heater may be a disk (end) heater or a combination of a disk heater with heating needles or rods. Other alternatives include a heating wire or filament, for example a Ni—Cr (Nickel-Chromium), platinum, tungsten or alloy wire or a heating plate. Optionally, the heating element may be deposited in or on a rigid carrier material.

The electric heater may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy.

The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The electric heater may heat the aerosol-forming substrate by means of conduction. The electric heater may be at least partially in contact with the substrate, or the carrier on which the substrate is deposited. Alternatively, the heat from the electric heater may be conducted to the substrate by means of a heat conductive element.

Alternatively, the electric heater may transfer heat to the incoming ambient air that is drawn through the electrically heated aerosol-generating system during use, which in turn heats the aerosol-forming substrate by convection. The ambient air may be heated before passing through the aerosol-forming substrate.

Preferably, the device comprises a mouthpiece. The mouthpiece is formed by a mouthpiece housing and the extractor disposed within the mouthpiece housing. The mouthpiece is preferably a separable and replaceable component of the aerosol-generating device. It is called a mouthpiece because it is positioned at the mouth end or downstream end of the device. The mouthpiece preferably refers to a part of the housing of the aerosol-generating device and is positioned at an end of the device. During use, the aerosol-generating article containing aerosol-forming substrate is preferably partially contained within the mouthpiece of the aerosol-generating device. During use, a user does not puff directly on the mouthpiece or mouthpiece housing but puffs on an aerosol-generating article extending therefrom. Accordingly, the mouthpiece may be considered to form the most downstream part of the aerosol-generating device, and therefore be the part of the device positioned closest to the mouth of the user when in use. Advantageously, the mouthpiece can be manufactured and sold separately providing a user with a choice of personalisation of the device with different mouthpieces having different technical and/or aesthetic features or characteristics.

Preferably, the extractor body is fixedly coupled to the mouthpiece so that that extractor body does not move relative to the mouthpiece or mouthpiece housing.

Preferably, the effective diameter of the extractor, that is the diameter of the body plus the radial distance the resilient coupling extends from the extractor body, is smaller than the diameter of, at least, the portion of the mouthpiece housing the extractor. Additionally, the mouthpiece housing should also be sized to receive at least a portion of an aerosol-generating article. There should be clearance within the mouthpiece housing between the mouthpiece housing and the extractor so that the heater casing can slide within the mouthpiece housing and the extractor within the heater casing.

Preferably, the heater extends longitudinally with respect to the device and is configured to penetrate an internal portion of an aerosol-generating article. Preferably, the heater protrudes longitudinally. For example, the heating element is preferably in the form of a heater blade so as to internally heat the aerosol-generating substrate of the aerosol-generating article received within the extractor. Further, a protruding or extending heater is easier to clean after use and easy to replace in case of damage or wear.

Preferably, an end of the body of the extractor comprises an aperture for allowing the heater to be received in the cavity of the extractor. Preferably, the aperture is provided on the second end of the extractor. Preferably, the second end of the extractor provides a face for an aerosol-generating article to abut against, thereby supporting the article within the extractor.

Preferably, the body of the extractor is configured to slide within the heater casing of the aerosol-generating device. The body of the extractor may comprise a sliding receptacle for receiving an aerosol-generating article, the sliding receptacle being slidable within the heater casing. The terms "extractor body" or "body of the extractor" may be interchangeably used throughout the present specification with the terms "sliding receptacle" or "slidable receptacle".

The resilient nature of the resilient coupling element when located and deflected inside the heater casing ensures a stable and secure frictional engagement of the coupling element with the interior of the heater casing.

Preferably, when the extractor is coupled to the heater casing, the extractor is configured to move between a first position and a second position. The first position is an operating position in which the heater extends into the cavity of the extractor body, and the second position is an extraction position in which at least part of the heater has been removed from the cavity.

As discussed above, the body of the extractor may comprise a sliding receptacle for receiving an aerosol-generating article. The sliding receptacle is thus slidable between the first position and the second position. Preferably, the entire mouthpiece including the sliding receptacle may move to translate the sliding receptacle between the first position and the second position. Alternatively, only the sliding receptacle of the extractor may be slidable between the first position and the second position.

Preferably, the extractor remains attached to the aerosol-generating device or heater casing when the extractor is in the first and second positions. More preferably, the extractor also remains attached to the aerosol-generating device when the extractor is located in positions between the first and second positions.

The first position of the sliding receptacle is an operating position in which the heater can heat the aerosol-forming substrate of the aerosol-generating article to form the aerosol. As known to those of ordinary skill in the art, an aerosol is a suspension of solid particles or liquid droplets or both solid particles and liquid droplets in a gas, such as air. The second position of the sliding receptacle is an extraction position which facilitates removal of the aerosol-generating article by a user or consumer from the aerosol-generating device. The upstream and downstream ends of the aerosol-generating device are defined with respect to the airflow when the user takes a puff. Typically, incoming air enters the aerosol-generating device at the upstream end, combines with the aerosol, and carries the aerosol in the airflow towards the user's mouth at the downstream end.

Preferably, an aerosol-generating article including an aerosol-forming substrate is provided to the aerosol-generating device. In this embodiment, the aerosol-generating article remains substantially stationary relative to the sliding receptacle as the sliding receptacle slides between the first position and the second position. The term "substantially stationary" is defined as a variation in position on the order of millimeters during use of the aerosol-generating device. The receptacle or extractor body and the aerosol-generating article move relative to the other components of the aerosol-generating device, including the heater and heater casing. This allows removal of the aerosol-generating article from the aerosol-generating device to be achieved in two phases. In a first phase, the aerosol-generating article and sliding receptacle are moved by sliding, while the aerosol-forming substrate is supported, relative to components of the aerosol-generating device, in particular the heater. In a second phase, the aerosol-generating article, now separate from the heater, can be removed from the sliding receptacle.

Preferably, the heater casing includes a first coupling indent or aperture and a second coupling indent or aperture, and wherein when the extractor is in the first position, at least a portion of the resilient coupling element engages with the first coupling indent or aperture, and when the extractor is in the second position, at least a portion of the resilient coupling element engages with the second coupling indent or aperture.

Preferably, the portion of the resilient coupling element that engages with the coupling indents or apertures is the protrusion of the resilient coupling element.

Preferably, the heater casing comprising one or more apertures or indents for receiving the protrusion of the resilient coupling element. Advantageously, engagement of the resilient coupling element with either of the first or second coupling indent or apertures provides a secure and stable releasable coupling of the extractor. This can prevent any inadvertent exiting of a heated aerosol-generating article from the device. Furthermore, such an arrangement can allow for a snap-fit engagement between the device and the extractor. This can allow for easy coupling and decoupling of the extractor to the aerosol-generating device as well as a reliable tactile and audible feedback that the extractor has locked or engaged into place at either the first or second positions.

Preferably, the first coupling indent or aperture is provided further away from the open end of the heater casing than the second coupling indent or aperture. Preferably, the second coupling indent or aperture is provided closer to the open end of the heater casing than the first coupling indent or aperture.

Preferably, the heater casing comprises a pair of indents or apertures corresponding to each resilient coupling element which is provided on the extractor. For example, if there are two resilient coupling elements provided on the extractor body, then the heater casing will preferably comprise two pairs of first and second coupling indents or apertures corresponding to each of the two resilient coupling elements. Preferably, where the heater casing has a substantially circular cross section, each pair of first and second coupling indents or apertures corresponding to each of the two resilient coupling elements may be equally spaced around the circumference of the heater casing.

Preferably, at least a portion of the resilient coupling element is configured to frictionally engage with an internal surface of the heater casing when the extractor moves between the first and second positions. Such frictional engagement can provide an improved more stable feel for the user when moving the extractor between the first and second positions. In particular, such frictional engagement can mean that the extractor does not move freely between the first and second positions, but instead requires user input. This can mean that the extractor only moves between the positions when the user is applying a movement force, and therefore does not move inadvertently (for example due to gravity) between said positions.

According to a third aspect of the present invention, there is provided a mouthpiece for an aerosol-generating device. The mouthpiece comprising a mouthpiece housing and an extractor according to the first aspect of the present invention, the extractor being disposed within the mouthpiece housing. The aerosol-generating device may be any aerosol-generating device in accordance with the second aspect of the present invention.

The aerosol-generating articles to be used with the present invention may comprise a plurality of elements, including the rod of aerosol-forming substrate. The outer wrapper may comprise a cigarette paper.

Aerosol-generating articles commonly comprise a hollow acetate tube directly adjacent to a rod of aerosol-forming substrate.

The rod of aerosol-forming substrate is formed of an aerosol-generating material, which is particularly preferably homogenised tobacco material.

As used herein, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise a minor quantity of one or more of tobacco dust, tobacco fines, and other particulate tobacco by-products formed during the treating, handling and shipping of tobacco. The sheets of homogenised tobacco material may be produced by casting, extrusion, paper making processes or other any other suitable processes known in the art.

The rod may comprise one or more sheets of a homogenised tobacco material that have been gathered to form a plug and circumscribed by an outer wrapper. As used herein with reference to the invention, the term "sheet" describes a laminar element having a width and length substantially greater than the thickness thereof. As used herein with reference to the invention, the term "gathered" describes a sheet that is convoluted, folded, or otherwise compressed or constricted substantially transversely to the longitudinal axis of the aerosol-generating article.

Preferably, the aerosol-forming substrate comprises a rod of the homogenised tobacco material circumscribed by a wrapper, wherein the wrapper is provided around and in contact with the homogenised tobacco material.

The rod of aerosol-forming substrate preferably has an external diameter that is approximately equal to the external diameter of the aerosol-generating article.

The rod of aerosol-forming substrate may have an external diameter of between about 5 millimetres and about 12 millimetres, for example of between about 5 millimetres and about 10 millimetres or of between about 6 millimetres and about 8 millimetres.

The rod of aerosol-forming substrate may have a length of between about 7 millimetres and about 15 mm.

Aerosol-generating systems according to the present invention comprise an aerosol-generating article as described in detail above in combination with an aerosol-generating device which is adapted to receive the upstream end of the aerosol-generating article. The aerosol-generating device comprises a heating element which is configured to heat the aerosol-forming substrate in order to generate an aerosol during use. Preferably, the heating element is adapted to penetrate the aerosol-forming substrate when the aerosol-generating article is inserted into the aerosol-generating device. For example, the heating element is preferably in the form of a heater blade.

The heating element is controlled during use to operate with a defined operating temperature range, below a maximum operating temperature.

Preferably, the aerosol-generating device additionally comprises a housing, an electrical power supply connected to the heating element and a control element configured to control the supply of power from the power supply to the heating element.

Suitable aerosol-generating devices for use in the aerosol-generating system of the present invention are described in WO-A-2013/098405.

During operation, the aerosol-generating article containing the aerosol-forming substrate may be completely contained within the aerosol-generating device. In that case, a user may puff on a mouthpiece of the aerosol-generating device. Alternatively, during operation the aerosol-generating article containing the aerosol-forming substrate may be partially contained within the aerosol-generating device. In that case, the user may puff directly on the aerosol-generating article.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may also have a length and a circumference substantially perpendicular to the length. The aerosol-forming substrate may be received in the sliding receptacle of the aerosol-generating device such that the length of the aerosol-forming substrate is substantially parallel to the airflow direction in the aerosol-generating device.

Features described in relation to one aspect of the invention may also be applicable to another aspect of the invention.

The invention will now be further described with reference to the figures in which.

Figure 1:
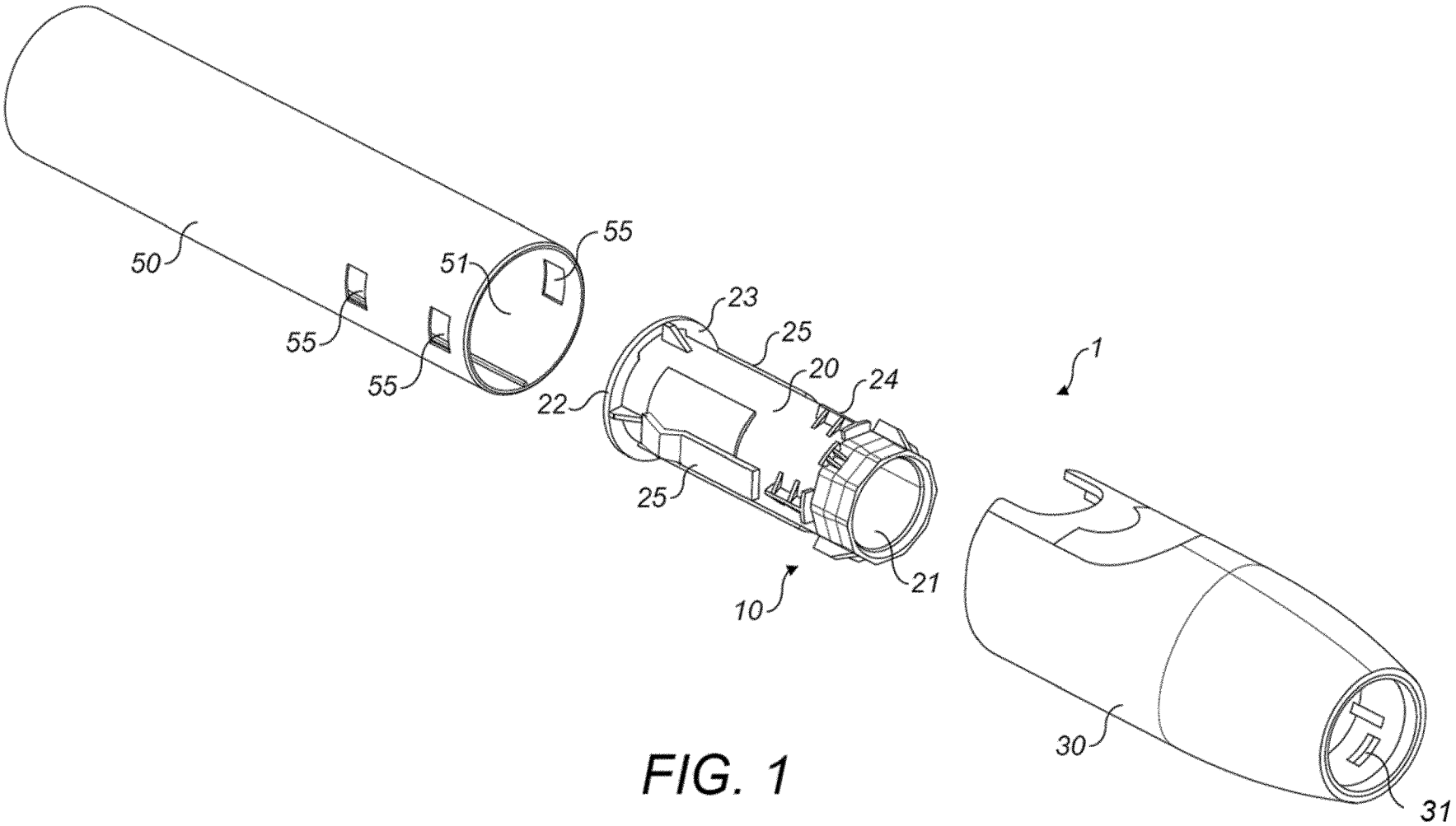
FIG. 1 shows an exploded perspective view of the extractor according to a first embodiment of the invention and a casing of the aerosol-generating device with which the extractor is configured to engage.
Figure 2:
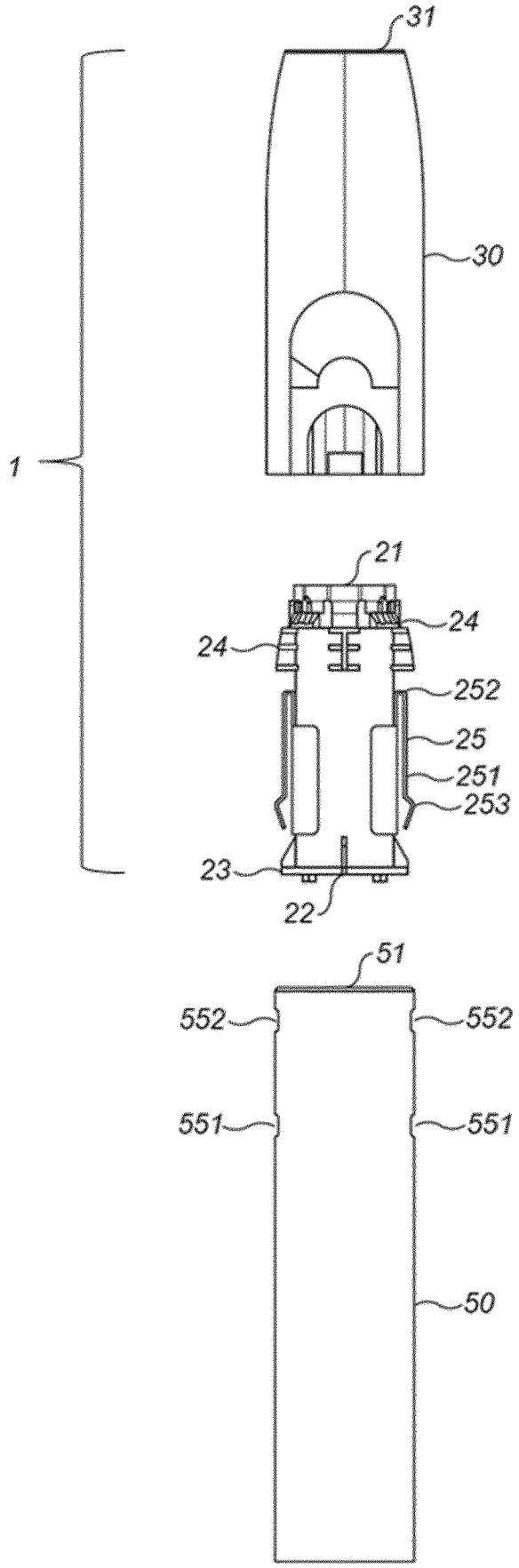
FIG. 2 shows an exploded top plan view of the extractor according to a first embodiment of the invention and a heater casing of the aerosol-generating device with which the extractor is configured to engage.
Figure 3B:
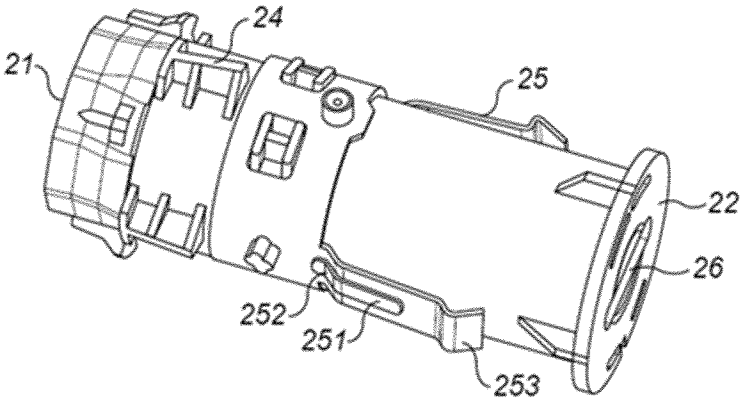
Figure 3A:
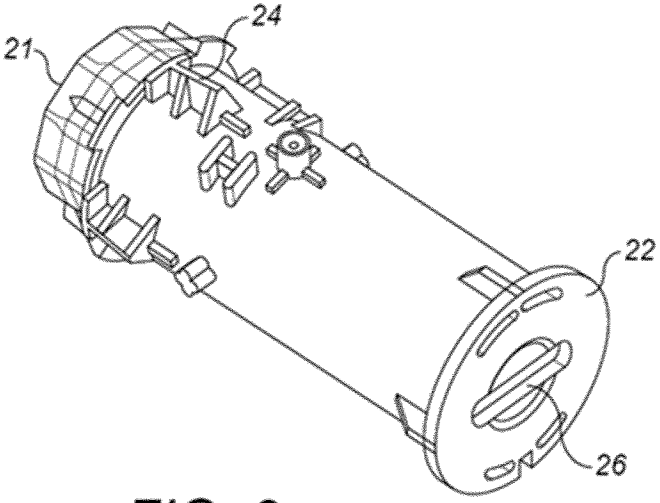
Figure 4:
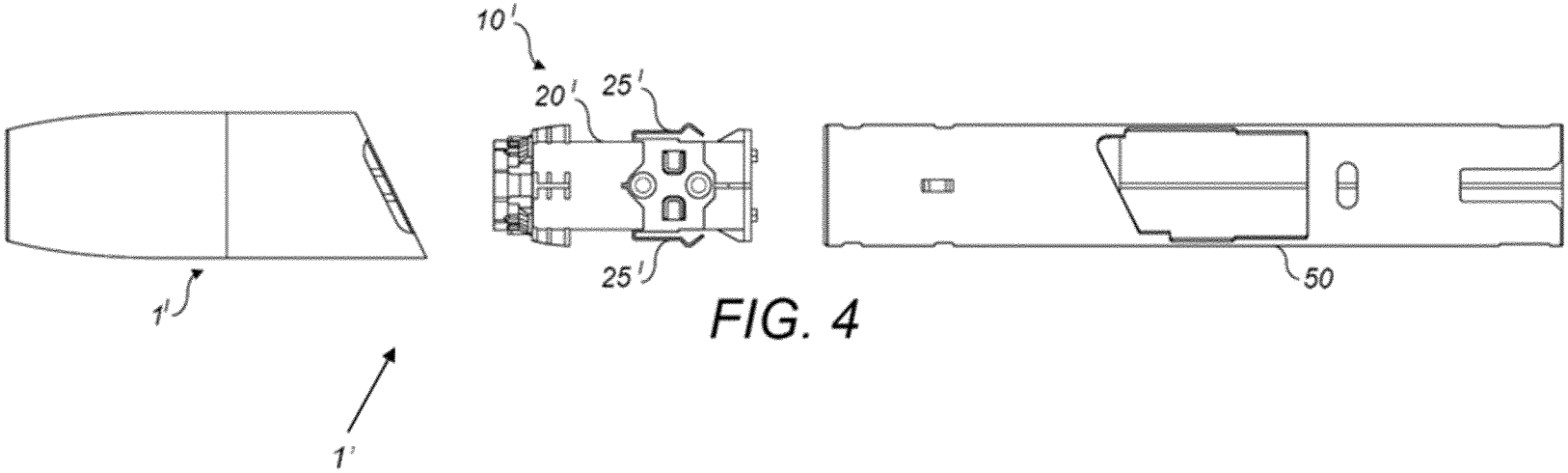
Figure 5:
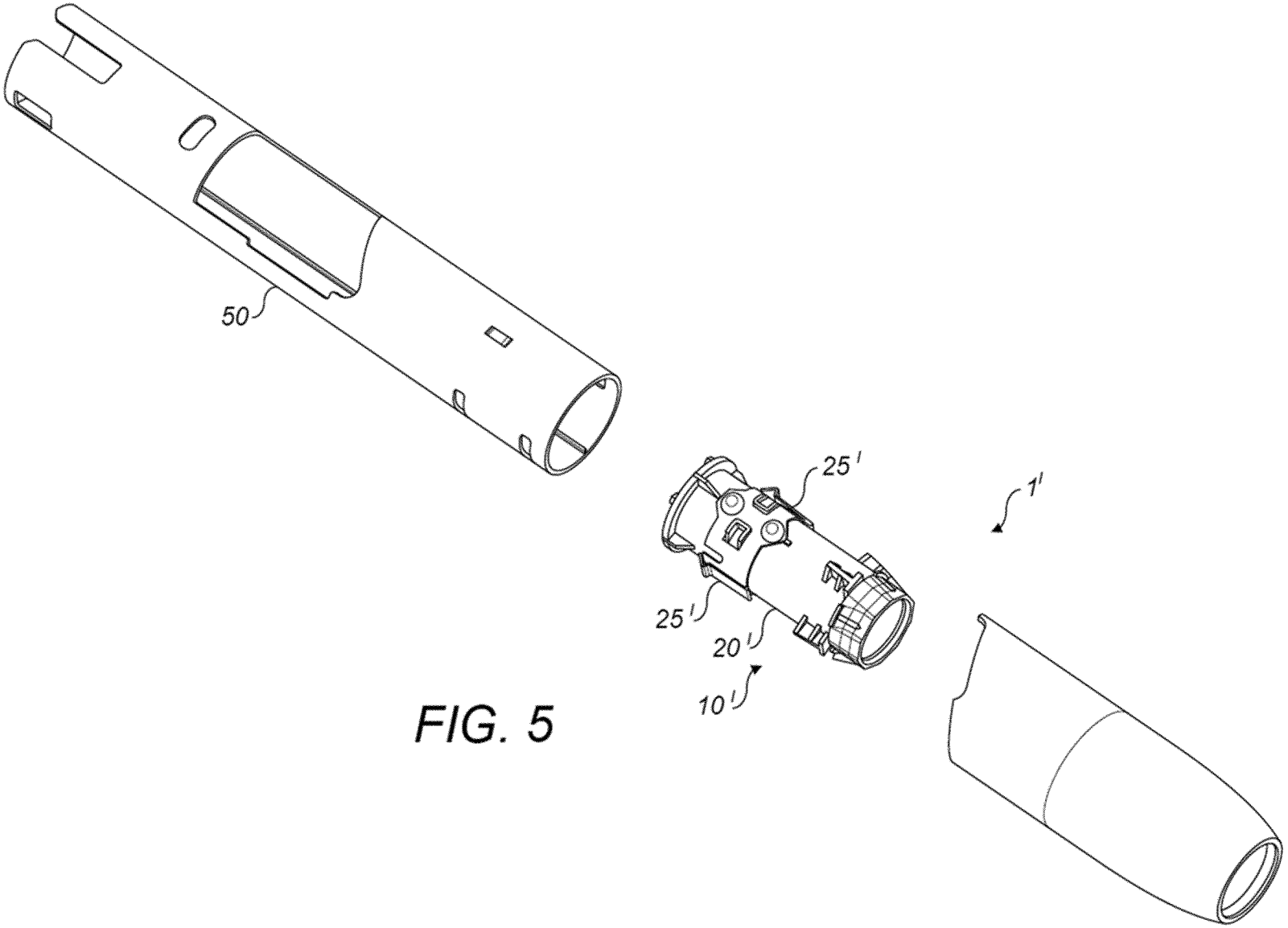
Figure 6A:
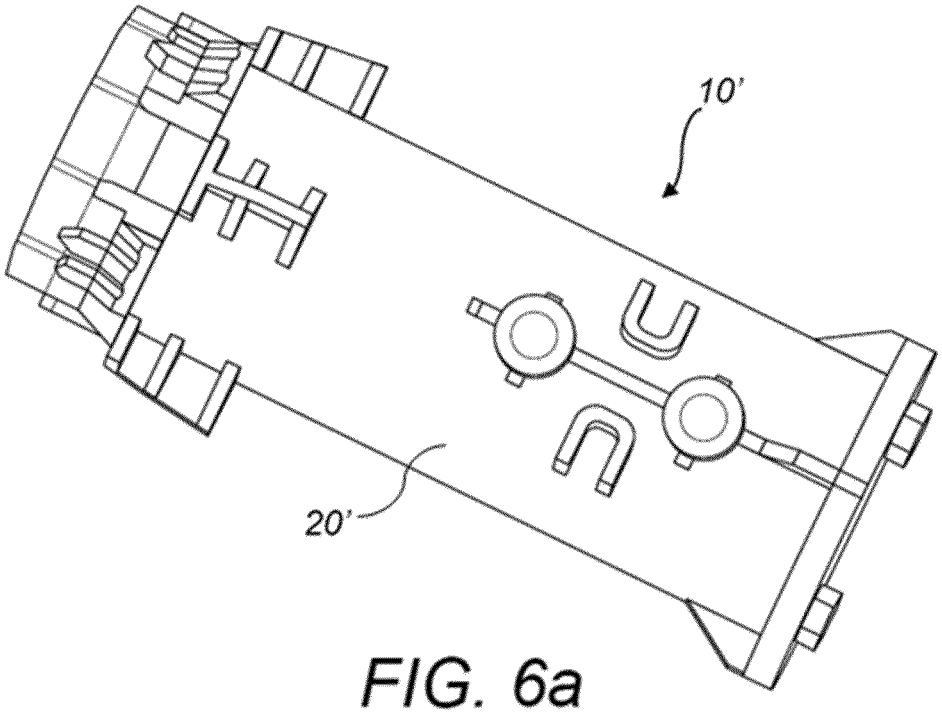
Figure 6B:
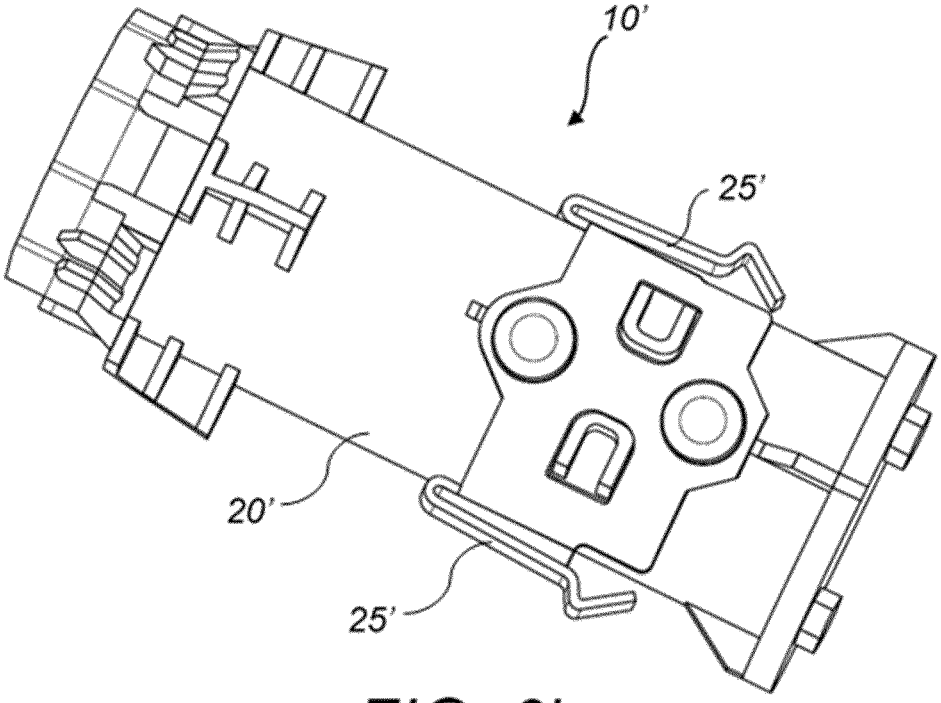
Figure 7A:
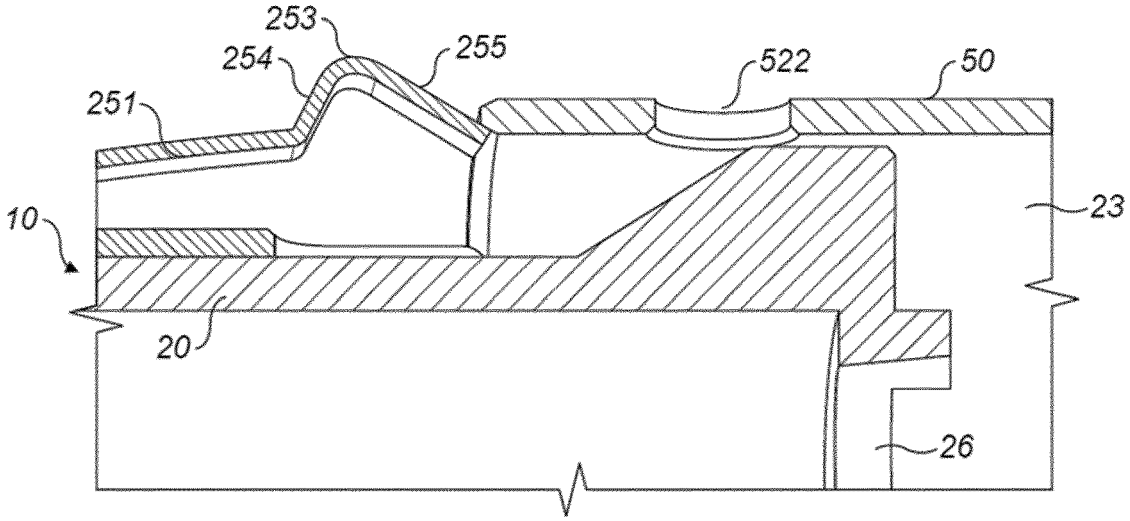
Figure 7B:
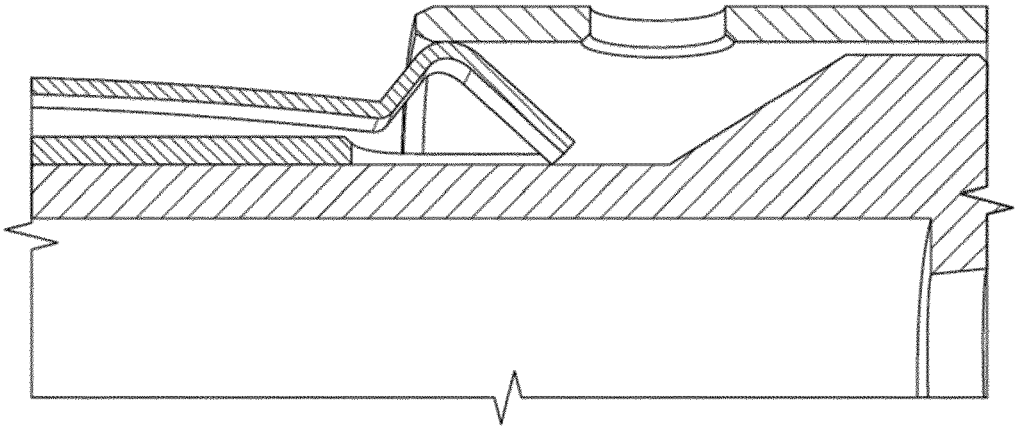
Figure 7C:
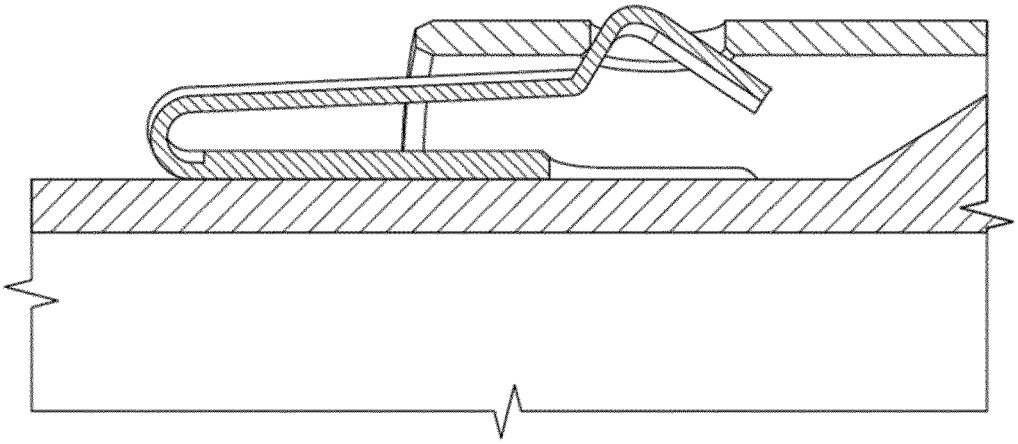
Figure 8:
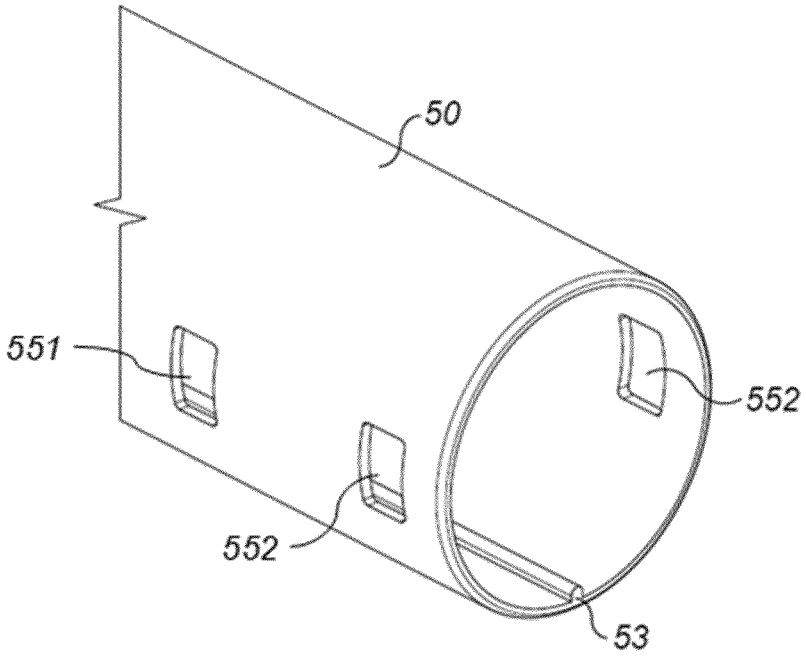
Figure 9:
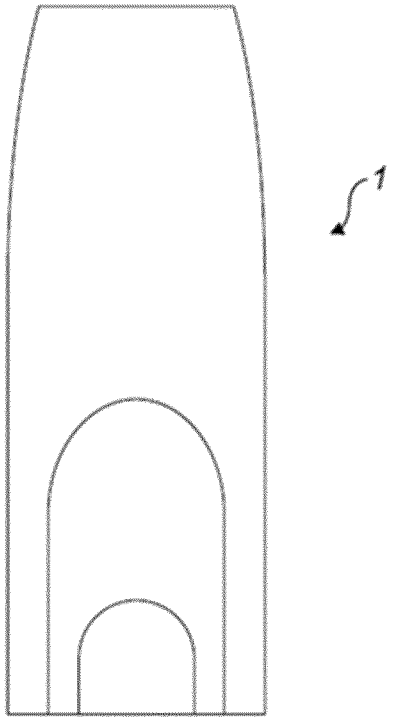

FIGS. 3*a* and 3*b* respectively show a perspective view of the body of the extractor with and without the resilient coupling elements, in accordance with a first embodiment of the invention;

FIG. 4 shows an exploded top plan view of the extractor according to a second embodiment of the invention and a heater casing of the aerosol-generating device with which the extractor is configured to engage;

FIG. 5 shows an exploded perspective view of the extractor according to a second embodiment of the invention and a heater casing of the aerosol-generating device with which the extractor is configured to engage;

FIGS. 6*a* and 6*b* respectively show a top plan view of the body of the extractor with and without the resilient coupling element, in accordance with a second embodiment of the invention;

FIGS. 7*a*, 7*b* and 7*c* show partial sectional views of the extractor of the present invention sliding within a heater casing of an aerosol-generating device;

FIG. 8 shows a perspective view of the heater casing of the aerosol-generating device;

FIG. 9 shows a front elevation view of a mouthpiece according to the present invention;

FIG. 1 shows a mouthpiece 1 according to a first embodiment of the present invention. As shown in FIGS. 1 and 2, the mouthpiece 1 comprises an extractor 10 for receiving an aerosol-generating article (not shown) and a mouthpiece housing 30 for housing the extractor 10. The mouthpiece 1 is configured to be attached to a downstream portion of an aerosol-generating device (not shown). Such a downstream portion, in the present invention, is a heater casing 50, shown in FIGS. 1, 2 and 8, configured to be releasably coupled to an aerosol-generating device and to contain a heater (not shown) of said device. Although the heater casing 50 is shown to be a separate component from the aerosol-generating device, it is possible for the heater casing 50 to be formed integrally with the device.

As shown in FIGS. 1, 2, 3*a* and 3*b*, the extractor body 20 defines a cavity for receiving an aerosol-generating article. The body 20, as shown in FIG. 1, includes a first end 21 and an opposed second end 22, wherein the first end 21 is open thereby defining an entrance or opening to the cavity of the body 20 and the second end 22 is substantially closed thereby providing a support face for the aerosol-generating article to abut against when the article is received within the extractor 10.

The extractor 10 is configured to be fixedly attached within a housing 30 of a mouthpiece 1. As shown in FIG. 1, the mouthpiece housing 30 has an open end 31 also for receiving an aerosol-generating article. Insertion of the aerosol-generating article into the mouthpiece 1 involves insertion of the aerosol-generating article through the open end 31 and into the cavity defined by the extractor body 20. The aerosol-generating article is considered to be fully inserted into the mouthpiece 1 once an aerosol-forming substrate end of the aerosol-generating article is abutting the interior face of the second, closed end 22. Due to the fixed attachment of the extractor 10 to the mouthpiece housing 30, the extractor 10 does not move relative to the mouthpiece housing 30 or mouthpiece 1.

As shown in FIGS. 1, 2, 3*a* and 3*b*, both the extractor body 20 and the heater casing 50 comprise substantially cylindrical tubes. The diameter of the extractor body 20 is slightly smaller than that of the heater casing 50 so that the extractor body 20 can slide or move within the heater casing 50. The diameter of the extractor body 20 is also smaller than that of the upstream portion of the mouthpiece housing 30 so that the extractor 10 can be substantially contained within the mouthpiece housing 30. However, sufficient clearance must be provided between the extractor 10 and an inner surface of the mouthpiece to allow the extractor 10 to slide into and within the heater casing 50. Such clearance also allows air to flow into the extractor 10 and through the aerosol-forming substrate to take the aerosol formed during heating to a user downstream of the mouthpiece 1.

In use, the heater casing 50 will be substantially contained within the mouthpiece housing 30. This is advantageous because it prevents direct contact of a user with the heater casing 50 during use. During use, the heater casing 50 can become too hot to be touched by a user, thus the mouthpiece housing 30 and heater casing 50 also provide thermal insulation from the heater.

The heater (not shown) is supported on an interior face of the heater casing 50. As shown in FIGS. 1 and 2, the heater casing 50 comprises an open end 51 for receiving the extractor 10, and thus the aerosol-generating article located within the extractor 10, so that the aerosol-generating article can be heated by the heater. The heater (not shown) comprises a heating element extending longitudinally. The closed end 22 of the extractor body 20 comprises an aperture 26, shown in FIG. 3*a*, through which the heater is configured to extend into the cavity defined by the extractor body 20.

As shown in FIGS. 3*a* and 3*b*, the closed end 22 further comprises a flange 23 in the form of a projecting rim or collar, which abuts against the interior face of the casing 50 supporting the protruding heater. The extractor body 20 also comprises orientation lugs 24 ensuring that the body 20 is fitted and attached to the mouthpiece housing 30 at a correct orientation. The orientation lugs 24 cooperate with corresponding recesses (not shown) located in the interior of the mouthpiece housing 30. Having the extractor body 20 at the correct orientation also means that the aperture 26 will be aligned correctly with the heater when the extractor 10 is moved within the heater casing 50.

The extractor 10 further comprises two resilient coupling elements 25 attached to an outer surface of the extractor body 20, as illustrated in FIGS. 2 and 3*b*. The resilient coupling elements 25 are configured to be bendable or moveable independent of the body 20 when the extractor 10 is inserted into the open end 51 of the heater casing 50. As shown in FIGS. 2 and 3*b*, the resilient coupling elements 25 comprise resilient cantilevers or clips formed of a first portion 251 and a second portion 252 integrally joined together. The first portion 251 substantially extends along direction from the open end 21 of the extractor body 20 to the closed end 22 of the extractor body 20. Therefore, the first portion 251 extends from a proximal end, closer to the open end 21 and attached to the body 20 via the second portion 252, to a distal end, closer to the closed end 22 and spaced away from the body 20. The second portion 252 extends from a first end attached to the body 20 to a second end joined to the proximal end of the first portion 251 of the resilient coupling element. Therefore, a gap is present between the first portion 251 of the resilient coupling element 25 and the body 20 of the extractor 10 allowing space for the resilient coupling element to bend towards when undergoing deformation when sliding within the heater casing 50.

As illustrated in FIGS. 2 and 3*b*, the resilient coupling elements 25 comprise a protrusion 253 provided on the distal end of the first portion 251 of the each resilient coupling element 25. The protrusion 253 extends away from the body 20 and is arranged to cooperatively engage with coupling apertures 55 located along the heater casing 50. As shown in the FIG. 2, the protrusion 253 is in the form of a protruding bent portion of the resilient coupling element 25.

The resilient coupling elements 25 are arranged to have the protrusion 253 biased away from the body 20 of the extractor 10 so that in an undeformed or undeflected state of the resilient coupling element 25 there is a gap between the first portion 251 of the resilient coupling element 25 and the extractor body 20. In a deflected state, the first portion 251 is bent towards the body 20 of the extractor 10, as shown in FIG. 7*b*. Thus, the effective diameter of the extractor 10, that is, the diameter of the extractor 10 taking into consideration the resilient coupling elements 25 attached to the body 20 of the extractor 10, in an undeflected state (see FIG. 7*a*) is greater than the effective diameter of the extractor 10 in a deflected state (see FIGS. 7*a* & 7*c*) of the resilient coupling elements 25.

As shown in FIG. 8, the heater casing 50 comprises two pairs of coupling apertures 55 each of which are arranged to receive the protrusions 253 of each of the resilient coupling elements 25. Each pair of coupling apertures 55 is located at a different circumferential position on the heater casing 50, and each pair of coupling apertures 55 comprises a first and a second coupling aperture 551, 552.

The first coupling apertures 551 are arranged to releasably couple the extractor 10 to the heater casing 50 at a first, operating position, in which the heater of the aerosol-generating device can heat the aerosol-forming substrate of an aerosol-generating article located within the mouthpiece 1 and extractor 10. In the first position, the heater extends through the aperture 26 to penetrate and heat the interior of the aerosol-forming substrate so as to form an inhalable aerosol for a user to puff on.

The second coupling apertures 552 are arranged to releasably couple the extractor 10 to the heater casing 50 at a second, extraction position, in which the heater of the aerosol-generating device is at least partially removed from the aerosol-forming substrate of an aerosol-generating article located within the mouthpiece 1 and extractor 10 so that the removal of the article from the extractor 10 is facilitated. In the second position, the heater penetrates less into the aerosol-forming substrate than in the first, operating position, or does not penetrate the aerosol-forming substrate at all.

As a consequence of the respective purposes of the coupling apertures 551, 552, the first coupling apertures 551 are arranged further away from the open end 51 of the heater casing 50 than the second coupling apertures 552.

In use, a user inserts an aerosol-generating article into the mouthpiece 1 (shown in FIG. 9) when the extractor 10 is in the first position so that the heater penetrates the interior of the aerosol-generating article. The user activates the heater of the aerosol-generating device so that the heater heats the aerosol-forming substrate when the user puffs on the articles, thereby forming the aerosol. The heater could heat continuously after an initial activation, for example triggered by a first puff of the user or by a switch activated by the user, or could only heat when the user puffs on the article. The aerosol formed is carried in the air flow into the mouth of the user. When the aerosol-generating article is fully consumed, or the user considers the aerosol-generating article to be used up, the extractor 10 can be moved from the first, operating position into the second, extraction position. This may be achieved manually by the user pulling on the mouthpiece 1. In that case, the user may grip the mouthpiece 1 to pull the extractor 10 in a downstream direction from the heater casing 50. The extractor 10, and therefore the mouthpiece 1, is configured to completely detach from the heater casing 50 when the mouthpiece 1 is further pulled on when the extractor 10 is in the second, extraction position. This advantageously allows for replacement and cleaning of the mouthpiece 1 and extractor 10, as well as cleaning of the heater casing 50 and the heater contained therein.

FIGS. 7*a*, 7*b* and 7*c* show how the resilient coupling element 25 is configured to engage with the second coupling aperture 552 when the extractor 10 is being inserted into the heater casing 50, or re-inserted following extraction of the mouthpiece 1 from the aerosol-generating device. The protrusion 253 comprises a first sloped face 254 orientated towards the first, open end 21 of the extractor body 20 and a second sloped face 255 orientated towards the second, closed end 21 of the extractor body 20.

The effective diameter of the extractor 10, defined by the largest distance between the two opposed resilient coupling elements 25, is larger than the inner diameter defined by the heater casing 50. Thus, when the extractor 10 is being inserted into the heater casing 50, the second sloped faces 255 of the two resilient coupling elements 25 enter into contact with an inner edge of the heating case wall defining the open end 51. The slope of the second sloped face 255 is sufficiently gradually sloped so that further upstream progression or sliding of the extractor 10 into the heater casing 50 presses the second sloped face 255 against the inner edge of the open end 51, thus forcing the resilient coupling element 25 to deflect towards the body 20 of the extractor 10. The deflection of the resilient coupling element 25 towards the body 20 of the extractor 10, as shown in FIG. 7*b*, allows the extractor to frictionally engage with the inside of the heater casing 50. Upon further sliding of the extractor 10 within the heater casing 50, the protrusion 253 will encounter the second coupling aperture 552 at a distance away from the inner edge of the open end 51. The biased or resilient nature of the resilient coupling element 25 will force the protrusion 253 away from the extractor body 20 to releasably engage with the second coupling aperture 552, thereby positioning the extractor 10 into the second, extraction position. The protrusion 253 effectively snaps into the second coupling aperture 552. This is useful because the snap can provide a user with a tactile and audible indication that the extractor 10 has successfully engaged into the second, extraction position.

Further sliding of the extractor 10 upstream along the heater casing 50 enables the second sloped face 255 to be pressed against an upstream inner edge of the second aperture 552, thus, again, forcing the resilient coupling element 25 to deflect towards the body 20 of the extractor 10. The deflection of the resilient coupling element 25 towards the body 20 of the extractor 10, similar to that shown in FIG. 7*b*, allows the extractor to frictionally engage with the inside of the heater casing 50 at any location between the first coupling aperture 551 and the second coupling aperture 552. Upon further sliding of the extractor 10 within the heater casing 50, the protrusion 253 will encounter the first coupling aperture 551 at a distance away from the second coupling aperture 552 and further away from the inner edge of the open end 51. The biased or resilient nature of the resilient coupling element 25 will force the protrusion 253 away from the extractor body 20 to releasably engage with the first coupling aperture 551, thereby coupling the extractor 10 into the first, operating position. The protrusion 253 effectively snaps into the first coupling aperture 552. This is useful because the snap can provide a user with a tactile and audible indication that the extractor 10 has successfully engaged into the first, operating position.

Once the extractor 10 is in the first, operating position, a user may insert an aerosol-generating article into the extractor 10 so that it can be heated and puffed on. In some embodiments, further progression or sliding of the extractor 10 past the first operating position inside of the heater casing 50, will not be allowed because of the abutment of the closed face 22 and the flange 23 of the extractor body 20 with the interior face where the heater is supported within the heater casing 50. However, the engagement of the resilient coupling element 25 with the first coupling aperture 551 ensures that the extractor 10 is immovably coupled to the heater casing 50 during the operation of the aerosol-generating device and ensures that only deliberate action to release the extractor 10 from said engagement will do so.

As shown in FIGS. 7*a*, 7*b* and 7*c*, the second sloped face 255 is more gradually sloped than the first sloped face 254 to ensure that the force required to progressively slide the extractor 10 further within the heater casing 50 is less than that required to pull the extractor out of the second, extraction position. This also ensures that a deliberate higher force from a user is required to fully extract the extractor 10 from the heater casing 50 or move the extractor 10 from the first position to the second position. In other words, it is easier, that is, less force is required, to engage the extractor 10 in the first and second positions than to disengage the extractor 10 from said first and second positions.

Sliding the extractor 10 from the first, operating position to the second, extraction position or complete removal of the extractor 10 from the heater casing 50 involves a similar process to the engagement process described above. However, such disengaging movements will require a force in a downstream direction away from the heater, rather than an upstream direction towards the heater as described above, which involved insertion of the extractor 10 into the heater casing 50 and sliding from the second aperture 552 to the first aperture 551. The main difference is that the first slope face 254 will be pressed against respective downstream inner edges of the first and second coupling apertures 551 and 552 in order to deflect the resilient coupling element 25 towards the body 20 of the extractor 10 and enabling the extractor 10 to slide downstream the heater casing 50. As discussed above, because the first sloped face 254 is less gradually sloped than the second sloped face 255, the force required to push the extractor 10 downstream of the heater is greater than that required to push the extractor 10 upstream towards the heater.

FIGS. 4, 5, 6*a* and 6*b* show an alternative, second embodiment of a mouthpiece 1' and an extractor 10', which mainly differs from the first embodiment in that the resilient coupling elements 25' attached to the extractor 10' of the second embodiment are shorter in length than those of the first embodiment. In the first embodiment, the length of the resilient coupling elements 25 is equal to or between at least 50% and 100% of the length of the extractor body 20. In the second embodiment, the length of the resilient coupling elements 25' is less than at least 50% of the length of the extractor body 20'. All other features described above in relation to the first embodiment are present in the same form in the second embodiment. For this reason, features of the second embodiment for which reference numerals have been omitted can be considered to be substantially the same as those described in relation to the first embodiment of FIGS. 1, 2, 3*a* and 3*b*. The heater casing 50, with which the mouthpiece 1' of the second embodiment is configured to couple, is substantially the same as that described above and below.

FIG. 8 shows the downstream end of the heater casing 50. The heater casing 50 has a protruding guide track 53 running longitudinally along the interior surface of the heater casing 50. The guide track 53 is arranged to cooperate with a slot or groove (not shown) located on the outer surface of the extractor body 20. The engagement of the guide track 53 with such a corresponding slot on the extractor body 20 ensures that the extractor body 20 does not rotate and misalign when positioned or sliding within the heater casing 50.

FIG. 9 shows a mouthpiece 1 in accordance with the present invention. The mouthpiece housing 30 contains an extractor 10 in accordance with any of the first and second embodiments of the present invention described in detail above.

The invention claimed is:

1. An extractor configured to extract an aerosol-generating article received in an aerosol-generating device, the extractor comprising:

a body defining a cavity configured to receive an aerosol-generating article; and a resilient coupling element attached to the body, wherein the resilient coupling element is movable independent of the body to releasably couple the extractor to a portion of the aerosol-generating device.

2. The extractor according to claim 1, wherein the resilient coupling element comprises a longitudinal extension and is attached to the body such that the resilient coupling element has one end attached to the body and a remote end spaced away from the body.

3. The extractor according to claim 1, wherein the body has a first end defining an opening of the cavity and an opposed second end, and wherein at least a first portion of the resilient coupling element extends in a direction from the first end to the second end.

4. The extractor according to claim 3, wherein the first portion of the resilient coupling element extends from a proximal end of the first portion attached to the body to a distal end of the first portion spaced away from the body.

5. The extractor according to claim 3, wherein the resilient coupling element further comprises a second portion having a first end attached to the body and a second end disposed away from the body.

6. The extractor according to claim 3, wherein a protrusion is provided on the first portion of the resilient coupling element, the protrusion extending away from the body.

7. The extractor according to claim 6, wherein the protrusion has a first sloped face orientated towards the first end of the body, and a second sloped face orientated towards the second end of the body.

8. The extractor according to claim 7, wherein the second sloped face is more gradually sloped than the first sloped face.

9. The extractor according to claim 6, wherein the protrusion is provided on the distal end of the first portion of the resilient coupling element.

10. The extractor according to claim 1, wherein the resilient coupling element is separable from the body.

11. The extractor according to claim 1, further comprising one or more additional resilient coupling elements, wherein each additional resilient coupling element is attached to the body and is movable independent of the body to releasably couple the extractor to a portion of the aerosol-generating device.

12. An aerosol-generating device configured to receive an aerosol-generating article, the aerosol-generating device comprising:

a heater casing containing a heater configured to heat the aerosol-generating article; and an extractor according to claim 1, wherein the resilient coupling element is configured to releasably couple the extractor to the heater casing.

13. The aerosol-generating device according to claim 12, wherein when the extractor is coupled to the heater casing, the extractor is configured to move between a first position and a second position, the first position being an operating position in which the heater extends into the cavity of the extractor body, and the second position being an extraction position in which at least part of the heater has been removed from the cavity.

14. The aerosol-generating device according to claim 13, wherein the heater casing includes a first coupling indent or aperture and a second coupling indent or aperture, and wherein when the extractor is in the first position, at least a portion of the resilient coupling element engages with the first coupling indent or aperture, and when the extractor is in the second position, at least a portion of the resilient coupling element engages with the second coupling indent or aperture.

15. The aerosol-generating device according to claim 13, wherein at least a portion of the resilient coupling element is configured to frictionally engage with an internal surface of the heater casing when the extractor moves between the first and the second positions.

16. A mouthpiece for an aerosol-generating device, the mouthpiece comprising:

a mouthpiece housing; and an extractor according to claim 1, disposed within the mouthpiece housing.

* * * * *